US011970756B2

(12) United States Patent
Becker et al.

(10) Patent No.: US 11,970,756 B2
(45) Date of Patent: Apr. 30, 2024

(54) ALUMINUM ALLOY AND OVERAGED ALUMINUM ALLOY PRODUCT OF SUCH ALLOY

(71) Applicant: OTTO FUCHS—KOMMANDITGESELLSCHAFT, Meinerzhagen (DE)

(72) Inventors: Joachim Becker, Meinerzhagen (DE); Matthias Hilpert, Marienheide (DE); Thomas Witulski, Meinerzhagen (DE); Michael Besel, Meinerzhagen (DE)

(73) Assignee: OTTO FUCHS KOMMANDITGESELLSCHAFT, Meinzerhagen (DE)

( * ) Notice: Subject to any disclaimer, the term of this patent is extended or adjusted under 35 U.S.C. 154(b) by 691 days.

(21) Appl. No.: 17/052,385

(22) PCT Filed: Jul. 2, 2018

(86) PCT No.: PCT/EP2018/067740
§ 371 (c)(1),
(2) Date: Nov. 2, 2020

(87) PCT Pub. No.: WO2020/007437
PCT Pub. Date: Jan. 9, 2020

(65) Prior Publication Data

US 2021/0164076 A1 Jun. 3, 2021

(51) Int. Cl.
*C22C 21/10* (2006.01)
*C22F 1/053* (2006.01)

(52) U.S. Cl.
CPC ..... *C22C 21/10* (2013.01); *C22F 1/053* (2013.01)

(58) Field of Classification Search
CPC ..... C22C 21/10
See application file for complete search history.

(56) References Cited

U.S. PATENT DOCUMENTS

| | | | |
|---|---|---|---|
| 10,301,710 | B2 | 5/2019 | Fischer |
| 2006/0157172 | A1 | 7/2006 | Fischer et al. |
| 2011/0111081 | A1* | 5/2011 | Chen ..... C22C 21/10 425/542 |

FOREIGN PATENT DOCUMENTS

| | | | |
|---|---|---|---|
| CN | 1780926 | A | 5/2006 |
| CN | 106191576 | A | 12/2016 |
| EP | 1683882 | A1 | 7/2006 |
| JP | H042741 | A | 1/1992 |
| WO | 2002052053 | A1 | 7/2002 |
| WO | 2018025275 | A1 | 2/2018 |

OTHER PUBLICATIONS

Examination Report dated Oct. 19, 2021 in related Russian application 2020134854.
Examination Report dated Feb. 7, 2023 in related Japanese application 2020-573338.
Examination Report dated Jun. 28, 2022 in related Japanese application 2020-573338.
"Environmentally Assisted Cracking in certain Aluminium Alloys", Safety Information Bulletin (SIB) No. 2018-04, European Aviation Safety Agency (EASA), issued Feb. 2, 2018 [2 pages].
International Search Report of the ISA/EP dated Aug. 28, 2018 in parent international application PCT/EP2018/067740.
Written Opinion of the ISA/EP dated Aug. 28, 2018 in parent international application PCT/EP2018/067740.
Chapter II Demand for international preliminary examination dated Oct. 12, 2018 in parent international application PCT/EP2018/067740.
International Preliminary Report on Patentability (Chapter II) of the IPEA/EP dated May 11, 2020 in parent international application PCT/EP2018/067740.
Examination Report dated Jan. 6, 2022 in related Chinese application 201880094261.0.
"Organization and Properties of Aluminum Alloys", Beijing: Metallurgical Industry Press, pp. 203-204 (Jul. 31, 1988).
Liao et al., "Aluminum Alloy Extrusion Production and Applications", Beijing: Metallurgical Industry Press, pp. 100-104 (Mar. 31, 2018) [The PDF text was too degraded to generate a machine translation. Per MPEP 609.04(a)(III), a concise explanation of relevance is provided by the "A" indication and discussion of this reference in the Chinese Examination Report.].

* cited by examiner

*Primary Examiner* — Jophy S. Koshy
(74) *Attorney, Agent, or Firm* — Polson Intellectual Property Law, PC; Margaret Polson; Christopher Sylvain

(57) ABSTRACT

The invention relates to an aluminum alloy having 0.04-0.1 wgt.-% Si, 0.8-1.8 wgt.-% Cu, 1.5-2.3 wgt.-% Mg, 0.15-0.6 wgt.-% Ag, 7.05-9.2 wgt.-% Zn, 0.08-0.14 wgt.-% Zr, 0.02-0.08 wgt.-% Ti, max. 0.35 wgt.-% Mn, max. 0.1 wgt.-% Fe, max. 0.06 wgt.-% Cr, optional 0.0015-0.008 wgt.-% Be, the remainder aluminum in addition to unavoidable impurities. The invention furthermore relates to an aluminum alloy product which is overaged according to T74xx, produced from such an alloy.

13 Claims, 6 Drawing Sheets

ALUMINUM ALLOY AND OVERAGED ALUMINUM ALLOY PRODUCT OF SUCH ALLOY

BACKGROUND

The present disclosure relates to an aluminum alloy, in particular an aluminum alloy from the 7000 group corresponding to the classification of the Aluminum Association (AA). The present disclosure further relates to an overaged aluminum alloy product produced from such an alloy.

In the aeronautics and space travel industry, high-strength aluminum alloys are necessary for producing mainly load-bearing fuselage, wing and landing gear parts, which exhibit high strength both under static and under dynamic stress. The required strength properties can be achieved by using alloys of the 7000 group corresponding to the classification of aluminum alloys made by the Aluminum Association (AA).

Highly stressed parts in aeronautics and space travel are made, for example, of the alloys AA7075, AA7175, AA7475 and particularly preferably of the alloys AA7049 and AA7050 which are used in the American region and of the alloys AA7010, AA7049A and AA7050A which are used in the European region.

In WO 02/052053 A1, a high-strength aluminum alloy of the aforementioned type is disclosed, which, in comparison to earlier alloys of the same type, has an elevated zinc content, coupled with a reduced copper and magnesium content. The total content of copper and magnesium together of this previously disclosed alloy amounts to less than 3.5 wt %. The copper content itself is indicated to be 1.2-2.2 wt %, preferably 1.6-2.2 wt %. In addition to the elements zinc, magnesium and copper, this previously disclosed alloy necessarily contains one or more elements from the group consisting of zirconium, scandium and hafnium with maximum proportions of 0.4 wt % zirconium, 0.4 wt % scandium and 0.3 wt % hafnium.

In EP 1 683 882 A1, an alloy with low quench sensitivity is disclosed, from which highly stressed parts, for example for use in the aeronautics and space travel technology, and thus components with high static and dynamic strength properties and simultaneously good fracture toughness and good stress corrosion cracking behavior, are produced, wherein these components can also have a thickness of more than 200 mm. This previously disclosed alloy consists of: 7 to 10.5 wt % Zn, 1.0 to 2.5 wt % Mg, 0.1 to 1.15 wt % Cu, 0.06 to 0.25 wt % Zr, 0.02 to 0.15 wt % Ti as obligatory alloy elements, wherein the sum of the alloy elements Zn+Mg+Cu is at least 9 wt %, and the rest being Al in addition to unavoidable impurities. In the production method described in this prior art, the semi-finished product produced from this aluminum alloy is overaged in a single step or in multiple steps in order to optimize the desired material properties. The fracture toughness determined for the semi-finished products produced from this alloy in a neutral environment according to ASTM E399 is improved in comparison to the previously disclosed prior art.

The relevant properties include, among others, fracture toughness as well as stress corrosion cracking resistance in surroundings influenced by the environment (according to ASTM E1823: environment assisted cracking; abbreviated EAC). For this purpose, stress corrosion cracking (SCC) is usually carried out in a salt water environment with the usual test set-up for determining the stress corrosion cracking resistance (SCC resistance). In the test set-up, for example, a pre-notched sample (for example, ASTM G168-00) is exposed to a force which attacks the test specimen in order to enlarge the notch or crack opening in the case of sufficient force such that crack formation occurs. With increasing crack length, the associated stress intensity factor (K factor) decreases until the crack formation finally ceases. If a test specimen is more SCC resistant, then less crack growth is observed or a higher load (in the form of the stress intensity factor K) is necessary for crack propagation, that is to say the higher the stress intensity factor is to which a notched test specimen can be exposed without observable crack propagation.

The SCC resistance of aluminum alloys can be very different in one and the same alloy depending on the environmental conditions in which the SCC test is performed. The state of the overaging of the semi-finished product or test specimen also has an influence on the SCC resistance. In an alloy according to AA7010, with increasing overaging of the test specimen starting from the T6 state via the state T76 to the state T74, the SCC resistance increases significantly, in particular also in a salt water environment. Other 7xxx alloys in the conventional SCC test (i.e., in salt water) generally exhibit the same behavior. With changed environmental conditions (for example, high humidity at elevated temperature), it has been shown that in particular 7xxx alloys with higher zinc content generally also have a tendency to undergo "environment assisted cracking" in the overaged state (i.e., T7x). Here, the crack propagation due to hydrogen embrittlement occurs preferentially along the grain boundaries (see, for example, EASA Safety Information Bulletin No. 2018-04). For AA7010, under such EAC environmental conditions, in the T6 state, $K_{IEAC}$ values between 6 and 7 MPa√m can be achieved; however, in the overaged state T74, the $K_{IEAC}$ values increase up to 25 MPa√m with clearly reduced strength in comparison to the T6 state due to the overaging. According to the above explanation, the K factor $K_{IEAC}$ here is a measure of the EAC resistance, since no crack propagation occurs for stresses $K_I<K_{IEAC}$.

The alloy (AA7037) disclosed in EP 1 683 882 A1, which is improved in terms of its strength properties compared to the alloy AA7010, surprisingly does not exhibit the expected EAC resistance with increasing overaging, as is observed in a test specimen made of the alloy AA7010. Even in the overaged T7452 state, with the alloy according to AA 7037, in a humid environment at elevated temperature (50° C., 85% relative humidity), an EAC resistance of only approximately $K_{IEAC}$=6 to 7 MPa√m can be achieved.

SUMMARY

Proceeding from this background, an aspect of the present disclosure is to propose an aluminum alloy from which an aluminum alloy product with strength values comparable to those of an alloy product made of the alloy AA7037 can be produced, but which also exhibits an improved EAC resistance under environmental influences which promote crack initiation and crack propagation.

This is achieved by an aluminum alloy with the following composition:

0.04-0.1 wt % Si,
0.8-1.8 wt % Cu,
1.5-2.3 wt % Mg,
0.15-0.6 wt % Ag,
7.05-9.2 wt % Zn,
0.08-0.14 wt % Zr,
0.02-0.08 wt % Ti
max. 0.35 wt % Mn, max. 0.1 wt % Fe,
max. 0.06 wt % Cr,
optionally 0.0015-0.008 wt % Be,
the rest being aluminum in addition to unavoidable impurities.

In the alloys described in the context of these embodiments, unavoidable impurities can be present with max. 0.05 wt % per element and in total with max. 0.15 wt %.

Concerning semi-finished products produced from such an alloy, it has been surprisingly observed that, in spite of a relatively high Zn content, the EAC resistance is considerably improved in comparison to the values that can be achieved with samples made of the alloy AA7037 even under corrosion cracking-promoting environmental influences. Nevertheless, the mechanical strength values are sufficiently high. The yield point $R_{p0.2}$ amounts to more than 440 MPa and can reach values of 460 MPa and higher in a forged part having a thickness of 150 mm. The fracture toughness is above 20 MPa√m and can reach values of 25 MPa√m and higher.

When performing an EAC test (ASTM E1823; ASTM G168) in an environment with a humidity of 85% and a temperature of 50° C., the SCC resistance surprisingly shows that no crack propagation is observed with an applied stress of $K_I$=20 MPa√m for a test duration of 30 days. Therefore, even under these environmental conditions, the EAC resistance of an alloy product produced from the alloy according to the present disclosure, in the case of overaging to the state T7xxx, is clearly improved in comparison to that of previously disclosed alloys, such as, for example, AA7037, or with respect to AA7010 in parts having a greater thickness (thickness≥100 mm, in particular also ≥150 mm). Here, it is found that this alloy or semi-finished products and products produced therefrom has/have a particularly low quench sensitivity. This means that, even as a result of a greater thickness (cross-sectional area), parts produced from the alloy undergo no losses or at least no significant losses in terms of their strength in the central sections due to their slow cooling. The consequence is that these parts exhibit high strengths, even in the case of large cross sections. It is precisely in high-strength aluminum alloy products, as used in aeronautics and space travel, that the EAC resistance in such an environment (85% relative humidity at 50° C.) is of particular interest. This result is surprising since the EAC resistance of an alloy product produced from an AA7037 alloy in the same overaged state does not suggest it. Finally, for the alloy product of the alloy AA7037, which is in the same overaged state, an EAC resistance of only approximately 6 to 7 MPa√m was determined with the same overaging.

Thus, while stress intensity factors $K_{IEAC}$ of approximately 6 to 7 MPa√m are achieved with alloy products produced from the aluminum alloy AA7037 in the EAC tests, in aluminum alloy products made of the alloy according to the present disclosure, these values are clearly higher than 20 MPa√m in the same overaging state. The achieved $K_{IEAC}$ values in aluminum alloy products made of the alloy according to the present disclosure are approximately 70% and higher with respect to the fracture toughness $K_{Ic}$ at room temperature. In many cases, the $K_{IEAC}$ values might even correspond to the $K_{IC}$ value (and thus cannot be experimentally determined for technical reasons), since no crack propagation could be observed over the test duration used (more than 30 days). The particular EAC resistance was not expected in light of the high Zn content. According to the prevailing teaching, higher Zn contents negatively affect the EAC resistance.

An aluminum alloy product produced from the aluminum alloy according to the present disclosure is overaged preferably in the state T74, T7451, T7452 or T7454. In this state, the aluminum alloy product still exhibits sufficient mechanical strength values as well as the desired SCC resistance both in the conventional immersion test in salt water solution and also in an environment favoring hydrogen-induced EAC, for example, in an environment with a humidity of 85% and a temperature of 50° C. If the overaging that does not reach the state T74 or T74xx, higher mechanical strength values can in fact be achieved, but in that case the SCC/EAC resistance generally does not appear to the desired extent. Overaging beyond T74/T74xx, on the other hand, leads to a further decrease of the mechanical strength values with generally improved SCC/EAC properties.

According to an embodiment of this aluminum alloy, the alloy contains 0.35 to 0.6 wt % Ag, in particular 0.40 to 0.50 wt % Ag. Interestingly, it has been shown that the above-described properties appear in an alloy having this Ag content, particularly with regard to the EAC resistance. In this embodiment of the alloy, the preferred Zn/Mg ratio is greater than 3.4 and up to and including 4.95. A Zn—Mg ratio between 3.5 and 4.25 is preferable. The preferred copper content of this alloy embodiment is between 0.8 and 1.35 wt % Cu, in particular between 0.9 and 1.2 wt % Cu, in connection with an Mn content between 0.18 and 0.3 wt %, in particular 0.2 to 0.25 wt %, and a Zn content between 7.1 and 8.9 wt %. If the Cu content in such an aluminum alloy is within the range of greater than 1.35 and up to 1.8 wt %, the alloy product has comparable alloy product properties if the Mn content is less than 0.1 wt %, in particular less than 0.05 wt %.

These special properties—high strength values and a particular EAC resistance—are exhibited in an alloy which has a lower Ag content compared to the above-described Ag content, namely when said content is less than 0.35 wt % Ag but more than 0.15 wt %. The Cu and Zn contents correspond to the Ag-richer alloy, wherein the Zn/Mg ratio is between 3.9 and 4.3. The present description of these example embodiments illustrates that the desired effects extend over the entire range of the claimed alloy.

The special properties of the alloy product produced from this alloy are to be associated with the very narrow spectrum of the elements participating in the alloy. Indeed, it is only with this composition that the desired EAC resistance can appear in the state T74/T74xx due to overaging of the alloy product produced from the alloy.

Be can optionally participate in the alloy. The introduction of Be into the melt is used for reducing the susceptibility to oxidation of same. Be can be included in the amount between 0.0015 and 0.008, in particular in the range of 0.0015 to 0.0035, for the mentioned purposes in the design of the alloy.

Preferably, the aluminum alloy product is plastically deformed after solution annealing and before aging.

BRIEF DESCRIPTION OF THE DRAWINGS

The below descriptions are provided using example embodiments. Reference is made to the appended figures which show the following results for test performances with test specimens according to ASTM G168 under the environmental conditions of 50° C. and 85% relative humidity.

DETAILED DESCRIPTION

Figure 1:
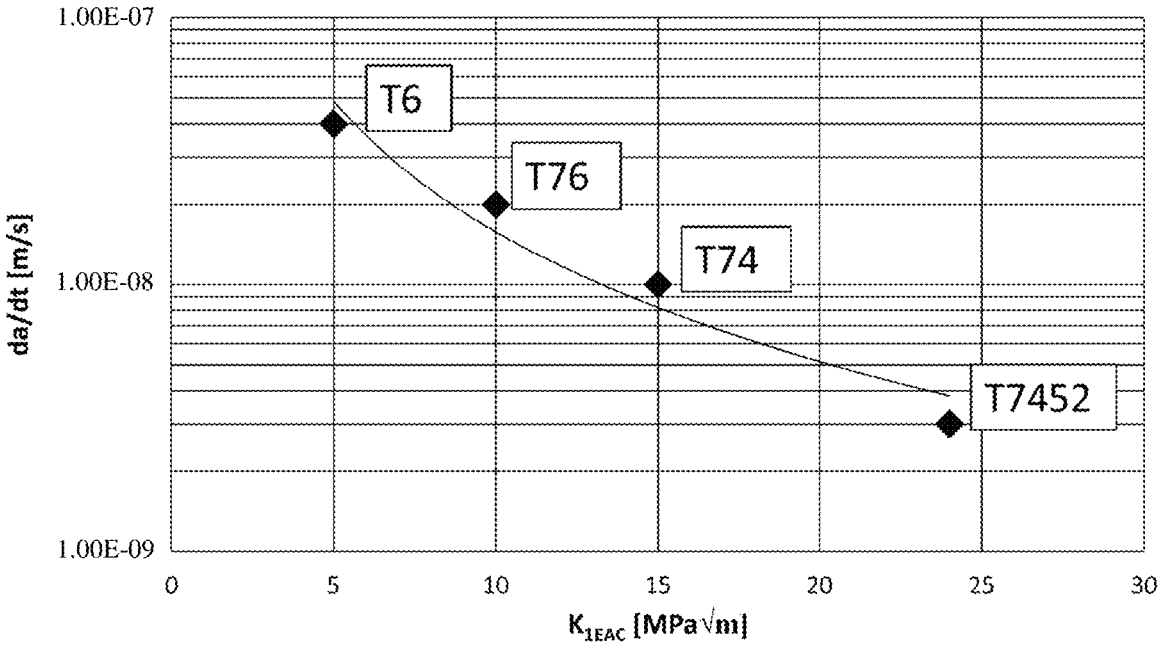
FIG. 1 shows a diagram for the representation of the EAC resistance in the form of the plateau cracking speeds as well as the $K_{IEAC}$ resistance of a conventional alloy AA7010 in different aging or overaging states.

From the comparison alloys and the test alloy, test specimens were produced as follows:

casting of bars made of the alloy;

homogenization of the cast bars at a temperature which is as close as possible to but under the melting temperature of the alloy for a heating and residence time sufficient to achieve the most even and finest possible distribution of the alloy elements in the cast structure, preferably at 460-490° C.;

heat forming of the homogenized bars by forging, extrusion molding and/or rolling in the temperature range of 350-440° C.;

solution annealing of the heat-formed semi-finished product at temperatures which are high enough to evenly solubilize the alloy elements necessary for the hardening in the structure, for example, at 465-500° C.;

quenching of the solution-annealed semi-finished products in water at a temperature between room temperature and 100° C. and in a water-glycol mixture or in a salt mixture at temperatures between 100° C. and 170° C.;

optionally cold heading (i.e., final state T7x52 alt. T7x54) or stretching (i.e., final state T7x51) of the product with heading/stretching degrees preferably in the range of 1 to 5%; and multistep heat storage of the quenched semi-finished product for overaging the semi-finished product to the state T74 or T7452/T7454/T7451.

The alloy compositions of the comparison alloys and of the test alloys in wt % are as follows:

| | Si | Cu | Mg | Ag | Zn | Zr | Mn | Fe | Cr | Ti | Al |
|---|---|---|---|---|---|---|---|---|---|---|---|
| AA 7010 | 0.1 | 1.65 | 2.3 | — | 6.3 | 0.11 | 0.02 | 0.08 | 0.02 | 0.03 | Rest |
| AA 7037 | 0.04 | 0.9 | 1.65 | — | 8.5 | 0.12 | 0.29 | 0.07 | 0.01 | 0.05 | Rest |
| E1 | 0.07 | 1.1 | 1.9 | 0.21 | 7.5 | 0.11 | 0.22 | 0.05 | — | 0.03 | Rest |
| E2 | 0.07 | 1.05 | 1.9 | 0.45 | 7.5 | 0.11 | 0.22 | 0.06 | — | 0.03 | Rest |
| E3 | 0.07 | 1.1 | 2.2 | 0.45 | 7.5 | 0.11 | 0.22 | 0.06 | — | 0.03 | Rest |
| E4 | 0.07 | 1.55 | 1.75 | 0.45 | 7.5 | 0.11 | — | 0.08 | 0.01 | 0.03 | Rest |
| E5 | 0.07 | 1.1 | 1.7 | 0.45 | 8.3 | 0.11 | 0.22 | 0.08 | — | 0.03 | Rest |
| E6 | 0.07 | 1.55 | 1.75 | 0.2 | 7.5 | 0.12 | — | 0.05 | — | 0.03 | Rest |

The samples in the state T7452 were subjected to an EAC test according to ASTM E1681 using DCB samples according to ASTM G168 in the present case at a relative humidity of 85% and a temperature of 50° C. The stresses of the samples provided with incipient cracking at the start of the test were between 20 and 30 MPa√m, respectively, depending on the determined fracture toughness. The investigations with regard to the EAC behavior on the DCB samples occurred in an S-L orientation. Thus, the $K_{IEAC}$ values relate to this orientation. The S-L orientation is the direction in which a sample is most susceptible to an EAC-induced failure. The sample is stressed in the ST direction of the forged piece (in the direction of the shortest extension). Thus, an incipient crack formation in L direction (direction of the greatest extension) is to be expected. The EAC tests were therefore carried out on S-L oriented samples.

Using the sample made of the alloy AA7010, FIG. 1 shows the influence of overaging on the increase of the $K_{IEAC}$ values as well as the simultaneous decrease of the initial crack propagation rate. While the $K_{IEAC}$ values in the state T6 are low and do not meet the requirements ($K_{IEAC}$ of 5 MPa√m), the EAC resistance is improved with increased aging. In the state T7452, the $K_{IEAC}$ value is 24 MPa√m. However, the mechanical strength values of this alloy are acceptable only up to the state T76 and exhibit a fracture toughness $K_{IC}$ of approximately 21 MPa√m and a yield point $R_{p0.2}$ of 470 MPa. Although in the state T7452, the $K_{IEAC}$ value of 24 MPa√m, is relatively high, as is the $K_{IC}$ value of approximately 32 MPa√m, the yield point $R_{p0.2}$ of 420 MPa is however not sufficient.

Figure 2:
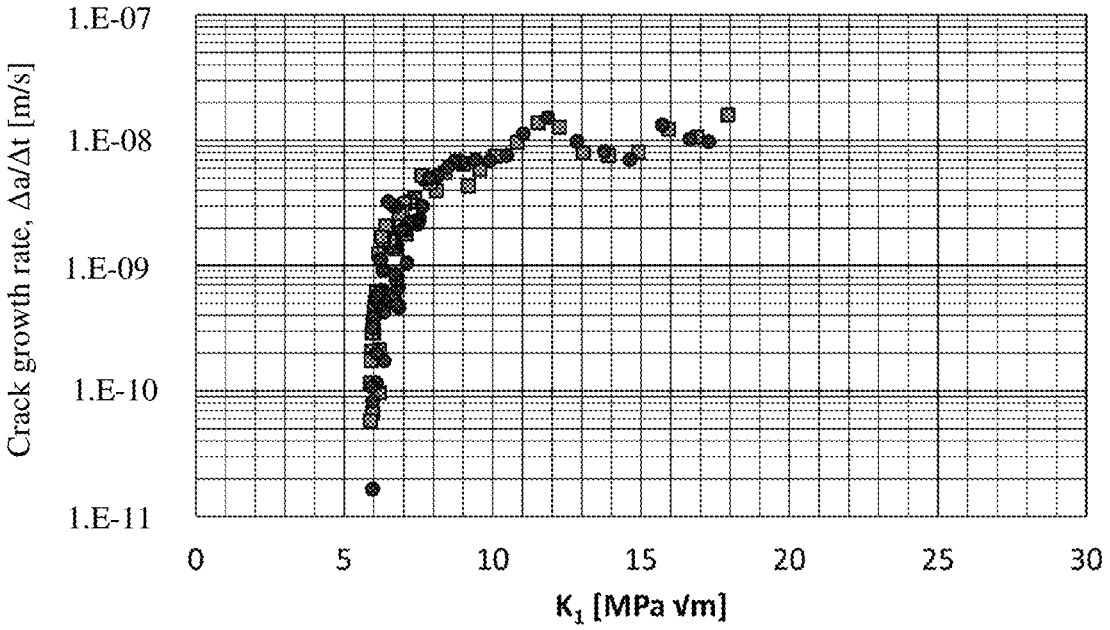
FIG. 2 shows a diagram for the representation of the test results of an EAC test under environmental influence (50° C./85% relative humidity) of two comparison samples made of an alloy AA7037.

Although the alloy AA7037, which is already improved in terms of strength with respect to the alloy AA7010, in the state T7452, exhibits sufficient mechanical strength values with a yield point $R_{p0.2}$ of 450 MPa and more and a fracture toughness $K_{IC}$ of approximately 30 MPa√m, it does not have a sufficient EAC resistance to meet the requirements, see FIG. 2. The $K_{IEAC}$ value is approximately 6 MPa√m.

Figure 3:
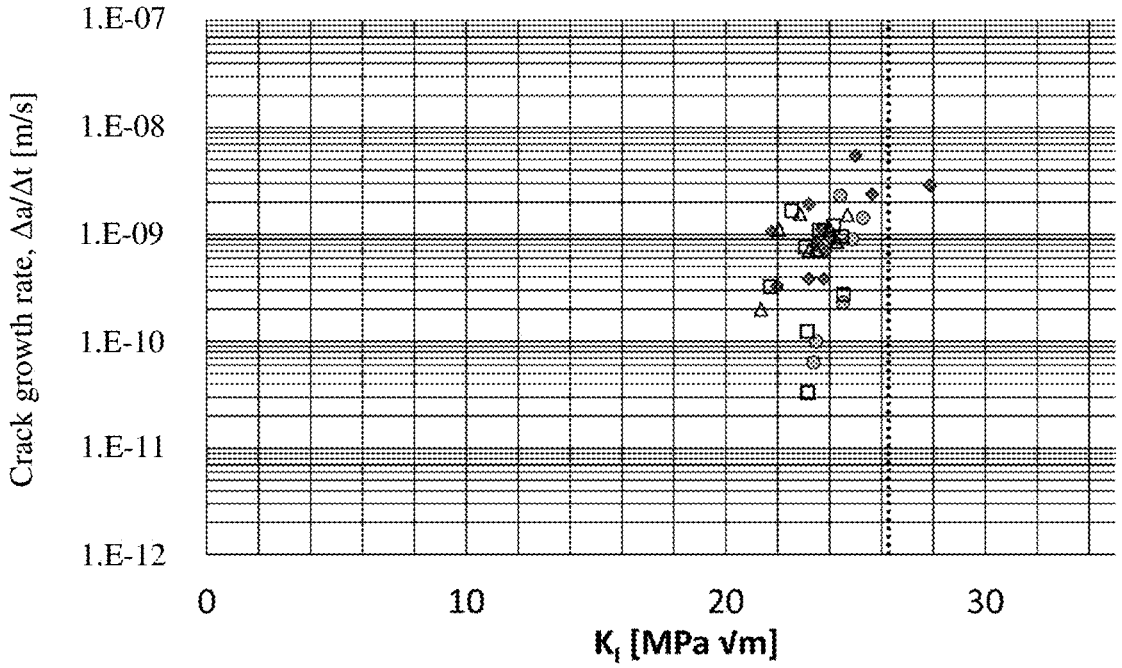
FIGS. 3-6 show diagrams corresponding to that of FIG. 2, representing the test results of respectively two to four test specimens made of the alloys according to the present disclosure.

In contrast, as can be seen from the diagram of FIG. 3 with the sample E1 made of an alloy according to the present disclosure, $K_{IEAC}$ values of more than 20 MPa√m are achieved, wherein, regarding this sample, it can be noted that no crack propagation could be observed within the test duration of 30 days in the mentioned EAC environment. The nonoccurrence of crack propagation in the EAC-promoting environment (85% humidity, 50° C.) is apparent from the cluster of points for the different samples, which are only the result of dispersions in the crack length measurements. A typical stress cracking resistance behavior leading to crack propagation and fracture can be seen in the diagram of FIG. 2 in reference to the sample made of the alloy AA7037. For E1, the yield point $R_{p0.2}$ is approximately 480 MPa. The fracture toughness $K_{IC}$ here is approximately 26 MPa√m (S-L sample orientation).

Figure 4:
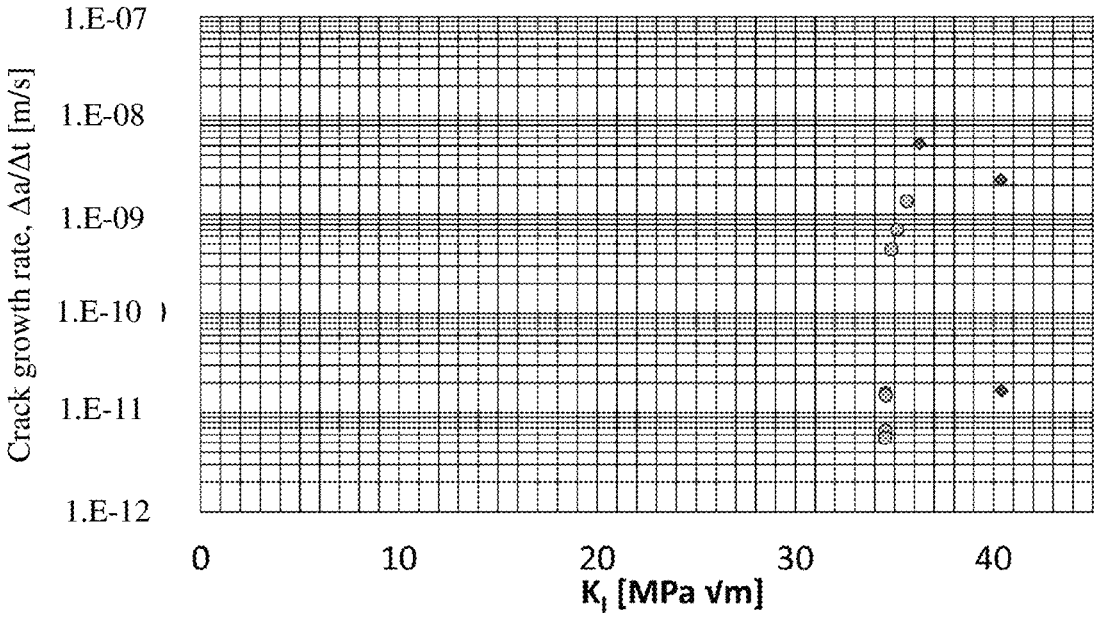

FIG. 4 shows a diagram corresponding to the diagram of FIG. 3 with the results of a sample of alloy E2. In this sample as well, within the test duration of 30 days, no crack propagation could be observed. The EAC resistance is reflected in the achieved $K_{IEAC}$ values of more than 35 MPa√m.

Figure 5:
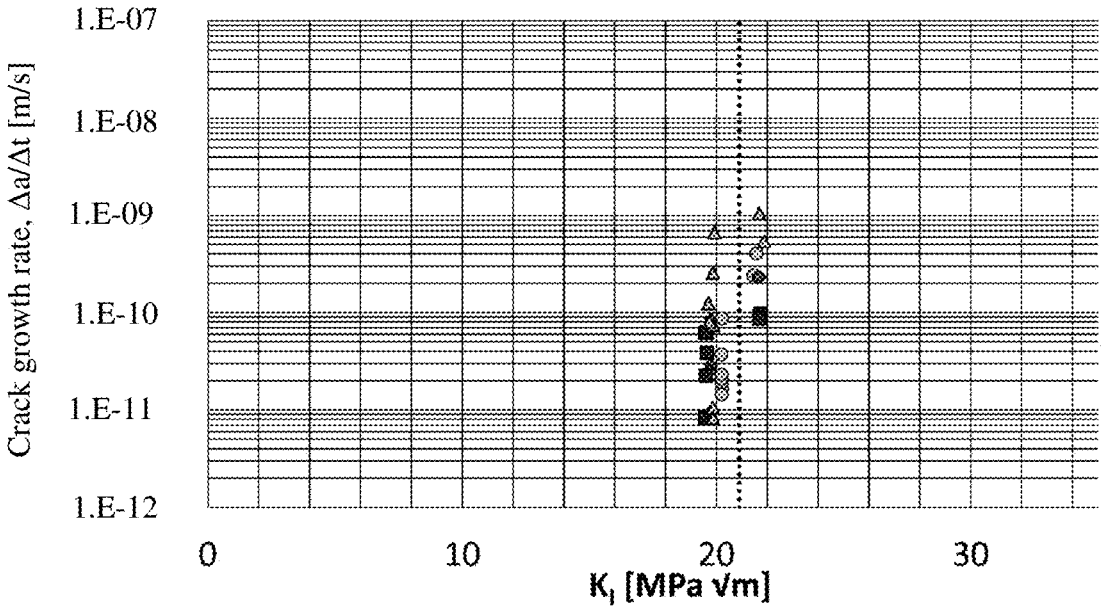

FIG. 5 shows an additional diagram of the aforementioned type with the achieved $K_{IEAC}$ values of approximately 20 MPa√m, which had been obtained with four samples made of the alloy E4. With regard to this sample too, no crack growth could be observed within the test duration of 30 days.

Figure 6:
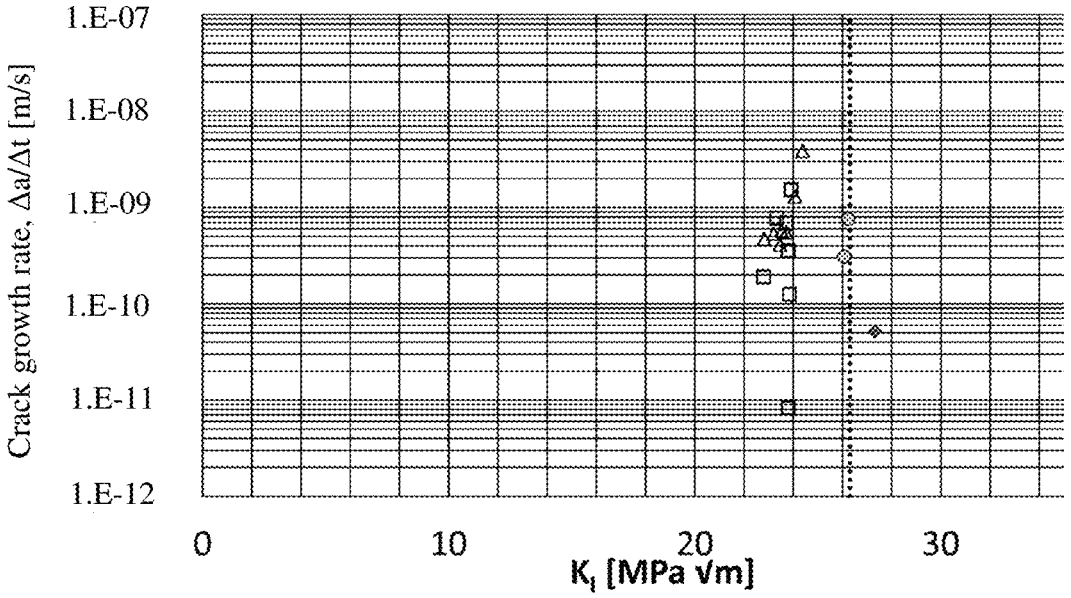

The $K_{IEAC}$ values, from four samples of the alloy E5 according to the present disclosure, can be obtained from the diagram of FIG. 6. They are between approximately 22 and 26 MPa√m. The cluster of points in this diagram as well illustrates that no crack growth could be observed within the test duration.

The above-discussed strength values of the test specimens made of the comparison alloys as well as of the test specimens of alloys E1-E6 according to the present disclosure are summarized in the following table:

| | EAC properties | Strength properties in T7452 | | |
|---|---|---|---|---|
| Alloy | in T7452 $K_{IEAC}$ [MPa√m] | $K_{IC,\ S\text{-}L}$ [MPa√m] | $R_{p0.2,\ L}$ [MPa] | $K_{IEAC}/K_{IC}$ |
| AA7010 | 24 | 32 | 420 | ≈75% |
| AA7037 | 6 | 22 | 450 | ≈27% |
| E1 | >20 | 26 | 482 | ≥80% |
| E2 | No crack growth > 20 | 23 | 466 | ≥90% |
| E3 | No crack growth > 20 | 20 | 470 | ≈100% |
| E4 | No crack growth > 20 | 21 | 487 | ≥90% |
| E5 | No crack growth > 20 | 26 | 467 | ≥90% |
| E6 | No crack growth > 20 | 22 | 470 | ≥90% |

The description of the alloys according to the present disclosure and of the overaged alloy products produced therefrom clearly shows that the EAC resistance of these alloy products is unexpectedly satisfactory.

The invention claimed is:

1. An aluminum alloy product having a composition consisting of:

0.04-0.1 wt % Si,
0.8-1.8 wt % Cu,
1.5-2.3 wt % Mg,
0.15 to less than 0.35 wt % Ag,
7.05-9.2 wt % Zn,
0.08-0.14 wt % Zr,
0.02-0.08 wt % Ti,
max. 0.35 wt % Mn,
max. 0.1 wt % Fe,
max. 0.06 wt % Cr,
optionally 0.0015-0.0035 wt % Be,
remainder Al in addition to unavoidable impurities, with a Zn/Mg ratio of 3.6-4.4, wherein the Zn and Mg in the Zn/Mg ratio are in weight percent;
wherein the aluminum alloy product has been overaged in accordance with T7451 or T7452 or T7454, the aluminum alloy product having a yield point ($R_{p0.2}$) of at least 440 MPa, a fracture toughness ($K_{Ic}$) of at least 20 MPa√m, and no crack propagation after performing an EAC test according to ASTM E1681 using DCB samples according to ASTM G168 under the following conditions:
in air at 50° C.,
at a humidity of 85%,
with a stress of up to 20 MPa√m, and
with a test duration of 30 days.

2. An aluminum alloy product having a composition consisting of:

0.04-0.1 wt % Si,
0.8-1.8 wt % Cu,
1.5-2.3 wt % Mg,
0.35-0.6 wt % Ag,
7.05-9.2 wt % Zn,
0.08-0.14 wt % Zr,
0.02-0.08 wt % Ti,
max. 0.35 wt % Mn,
max. 0.1 wt % Fe,
max. 0.06 wt % Cr,
optionally 0.0015-0.0035 wt % Be,
remainder Al in addition to unavoidable impurities, with a Zn/Mg ratio more than 3.4 and ≤4.9, wherein the Zn and Mg in the Zn/Mg ratio are in weight percent;
wherein the aluminum alloy product has been overaged in accordance with T7451 or T7452 or T7454, the aluminum alloy product having a yield point ($R_{p0.2}$) of at least 440 MPa, a fracture toughness ($K_{Ic}$) of at least 20 MPa√m, and no crack propagation after performing an EAC test according to ASTM E1681 using DCB samples according to ASTM G168 under the following conditions:
in air at 50° C.,
at a humidity of 85%,
with a stress of up to 20 MPa√m, and
with a test duration of 30 days.

3. The aluminum alloy product of claim 1, wherein the aluminum alloy product has 0.9-1.6 wt % Cu, and 7.15-8.3 wt % Zn.

4. The aluminum alloy product of claim 3, wherein the aluminum alloy product has 0.2-0.23 wt % Ag.

5. The aluminum alloy product of claim 3, wherein the aluminum alloy product has 7.3-7.8 wt % Zn.

6. The aluminum alloy product of claim 3, wherein the Zn/Mg ratio is in the range of 3.9 to 4.3.

7. The aluminum alloy product of claim 2, wherein the aluminum alloy product has 0.35-0.55 wt % Ag.

8. The aluminum alloy product of claim 2, wherein the aluminum alloy product has 0.8-1.35 wt % Cu, 0.18-0.3 wt % Mn, and 7.1-8.9 wt % Zn.

9. The aluminum alloy product of claim 2, wherein the aluminum alloy product has more than 1.35 to max. 1.8 wt % Cu, and less than 0.1 wt % Mn.

10. The aluminum alloy product of claim 7, wherein the aluminum alloy product has 0.40-0.50 wt % Ag.

11. The aluminum alloy product of claim 8, wherein the aluminum alloy product has 0.9-1.2 wt % Cu.

12. The aluminum alloy product of claim 8, wherein the aluminum alloy product has 0.2-0.25 wt % Mn.

13. The aluminum alloy product of claim 9, wherein the aluminum alloy product has less than 0.05 wt % Mn.

* * * * *